United States Patent [19]

Koch et al.

[11] Patent Number: 4,961,583

[45] Date of Patent: Oct. 9, 1990

[54] APPARATUS FOR PLAYING CHECKERS

[76] Inventors: Thomas P. Koch, 257 S. 1st St.; David N. Koch, 144 S. 5th St., both of Lehighton, Pa. 18235

[21] Appl. No.: 435,619

[22] Filed: Nov. 13, 1989

[51] Int. Cl.[5] ..... A63F 3/02; A63F 3/00

[52] U.S. Cl. ..... 273/260; 273/288; 273/287; D 21/24; D 21/52; D 21/20; D7/21

[58] Field of Search ..... 273/288, 287, 290, 260, 273/309, 282 R, 248, 249; D7/71; D21/24, 20, 52

[56] References Cited

U.S. PATENT DOCUMENTS

| | | | |
|---|---|---|---|
| 1,595,285 | 8/1926 | Bevan | 273/282 C |
| 3,191,184 | 6/1965 | Durstewitz | 273/249 |
| 3,211,458 | 10/1965 | Wells et al. | 273/248 |
| 3,531,123 | 9/1970 | Peebles | 273/260 |
| 3,994,498 | 11/1976 | Breslow | 273/287 |

FOREIGN PATENT DOCUMENTS

| | | | |
|---|---|---|---|
| 2632356 | 1/1978 | Fed. Rep. of Germany | 273/288 |

OTHER PUBLICATIONS

Drug and Cosmetic Industry Magazine, "News in Packaging" article, Jun. 1974, p. 79.

*Primary Examiner*—Benjamin Layno

[57] ABSTRACT

A game of checkers wherein the individual game pieces take the form of small drinking glasses. Each glass is filled with the same quantity of liquid, which may be soda pop or another similar beverage. When a player jumps his filled glass over one of the opponent's glasses he is permitted to drink the liquid from the opponent's jumped glass. The glasses are colored in contrasting colors to differentiate one player's glasses from the other player's glasses. Circular recesses are formed in the game board surface to hold the various glasses in place on the game board surface.

1 Claim, 1 Drawing Sheet

APPARATUS FOR PLAYING CHECKERS

BACKGROUND AND SUMMARY OF THE INVENTION

This invention relates to a game of checkers, wherein the checkers take the form of small drinking glasses. Prior to playing the game the glasses (checkers) are filled with a liquid, such as soda pop, grape juice, chocolate milk, beer or other beverage. As a player moves his checker (filled glass) to jump over the opponent's checker he is permitted to drink the liquid in the opponent's glass; the empty glass is then removed from the board.

When a player has moved one of his drinking glasses (checkers) to the opponent's last row of squares (the king's row) the player drinks the liquid from that glass to indicate that the particular glass (checker) is a king: that empty glass is left on the board for movement backward and forward, with the powers of a king. The players recognize the king status by the fact that the empty glass remains on the board (other glasses on the board are liquid-filled).

The game ends when one player has been able to remove all of the other player's checkers (glasses) from the game board, by jumping the other player's glasses.

The game offers an added incentive that each time a player jumps an opponent's glass he is permitted to consume the beverage in that glass. The game becomes a contest, with the winner consuming the major share of the liquids in the glasses.

THE DRAWINGS

DESCRIPTION OF A PREFERRED EMBODIMENT OF THE INVENTION

Figure 1:
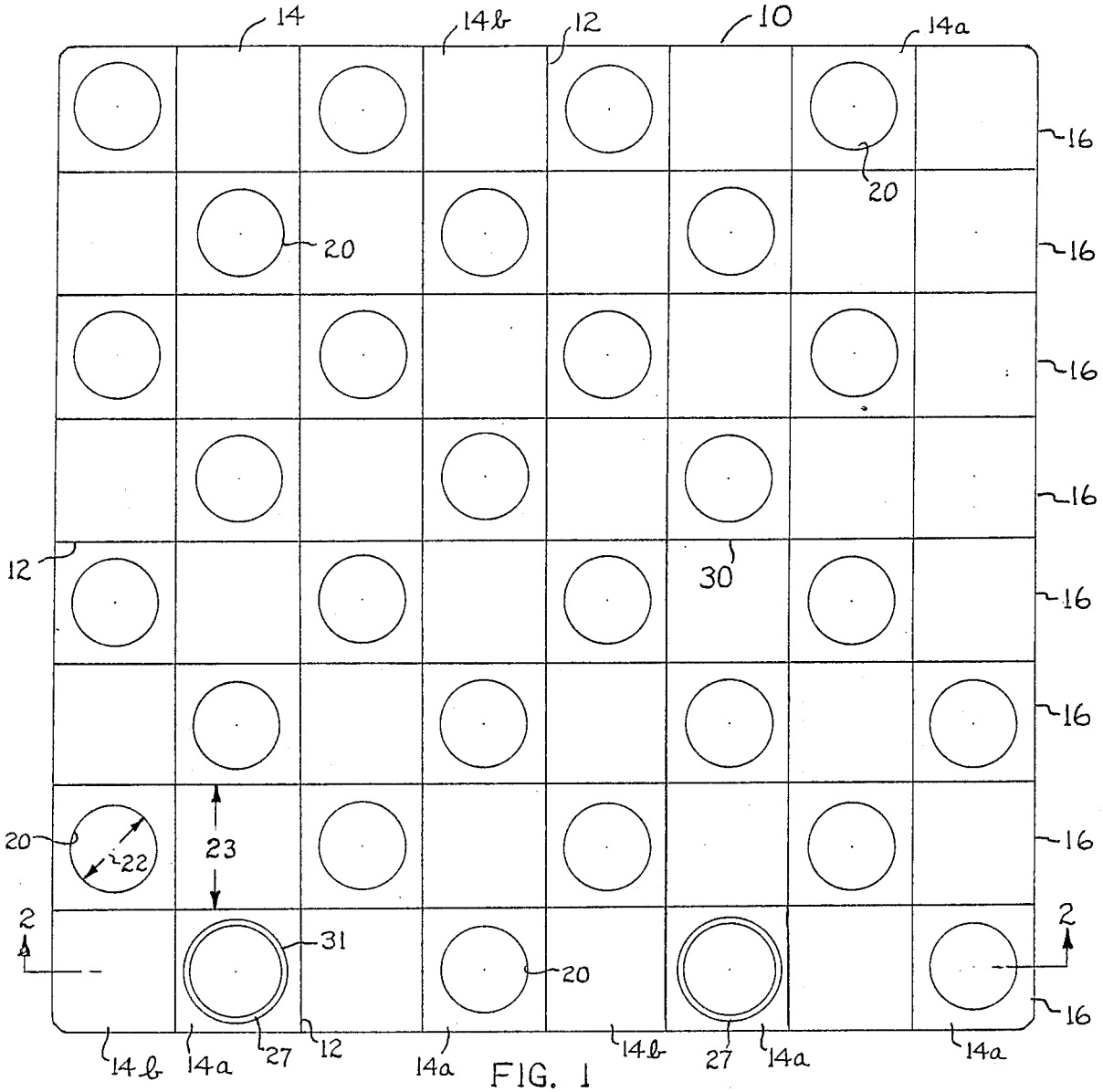
FIG. 1 is a top plan view of a game board and two drinking glasses embodying the invention.

FIG. 1 shows a square game board 10 embodying the invention. The upper face of board 10 has marking lines 12 thereon subdividing the board face into sixty four square spaces 14. These square spaces are arranged in eight parallel rows designated by numerals 16; there are eight squares in each row, making a total of sixty four squares. Alternating squares in each row are colored in contrasting colors, e.g. red and black, or yellow and black. Thus, there are thirty two squares of one color and thirty two squares of the other color. For differentiating purposes, the squares of one color are referenced with the numeral **14*a*, whereas the squares of the other color are referenced with the numeral 14*b***.

Each one of the squares **14*a* has a circular recess 20 indented into the board upper face. Each circular recess has a diameter 22 that is less than the corresponding edge-to-edge dimension 23 of the associated square 14*a***.

In the conventional checkers game there are twenty four game pieces (checkers) placed in the last three rows of squares on either side of the game board centerline; each checker takes the form of a circular disk. Our proposed game is similar to conventional checkers except that the individual game pieces take the form of drinking glasses; two such glasses are shown at 27 in FIG. 2. The game requires the use of twenty four glasses placed in the same positions on the game board as the conventional disk-type checkers.

Each drinking glass includes a circular bottom wall 29 and an annular circular side wall 31. Each glass may be of transparent plastic except that a colored band 33 is applied to the outer face of side wall 31 of each drinking glass. The bands on twelve of the glasses will be one color, e.g. red, whereas the bands on the other twelve glasses will be a contrasting color, e.g. gray or blue. The glasses will be placed on the game board, with the glasses of one color on one side of the board centerline 30, and the glasses of the other color on the other side of the board centerline. Each glass will be positioned in one of the circular recesses 20 indented into the game board surface.

Each colored band 33 will have a similar orientation on the associated drinking glass, such that the upper edge 34 of each band will form a liquid measuring line. After the twenty four empty glasses have been placed in recesses 20 on the game board the glasses will be filled with liquid to a level designated by edge line 34. This will ensure that each glass will have the same quantity of liquid therein.

The game is played under the usual rules applicable to checkers, except for two deviations. First, whenever a checker (filled glass) is jumped the player doing the jumping is permitted (required) to drink the liquid in the glass being jumped; the empty glass is removed from the board. Second, whenever a checker (filled glass) reaches the last row on the opponent's side of the board (the king's row) the moving player is permitted to drink the liquid from that glass, to thus signify the king status of that particular checker. The empty glass is left on the board, with a king's power to move backward or forward.

During the playing of the game some liquid is apt to spill from the glasses onto the game board surface. In order to facilitate easier cleaning of the board surface recesses 20 are formed with flat bottom surfaces 35 and annular side surface 37 that angle upwardly and outwardly from the bottom surfaces. The juncture lines between the various surfaces are rounded (not sharp).

Figure 2:
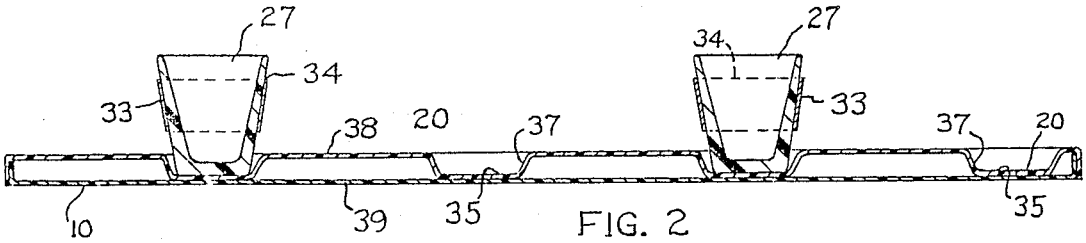
FIG. 2 is a sectional view taken on line 2—2 in FIG. 1.

The game board may be economically formed out of thin gauge plastic sheet materials. FIG. 2 shows the board formed out of an upper plastic sheet 38 having recesses 20 formed integrally therein, and a lower plastic sheet 39. Peripheral flanges may be formed on the two sheets to rigidify the game board edge areas, and also to seal the peripheral joint between the two sheets. The plastic game board may be washed with soap and water.

During the course of playing the game liquid may flow onto the game board surface, either due to condensation forming on glasses 27 or because liquid is spilled from one of the glasses. Small drainage holes 40 can be provided through the bottom walls of recesses 20.

The drawings necessarily show one specific form of the invention. It will be understood however that other structural arrangements may be employed in practice of the invention.

We claim:

1. Checker game apparatus comprising a game board having an upper face and a lower face; markings on the board upper face subdividing same into sixty four square spaces, arranged in eight parallel rows, eight squares per row; means coloring adjacent squares in contrasting colors;

said board upper face having circular recesses therein centered on the squares of a given color, making a total of thirty two recesses; each circular recess having a diameter less than the edge-to-edge dimension of the associated colored square;

twenty four identical hollow drinking glasses that serve as checkers; each drinking glass having a circular bottom wall having a diameter slightly less than the diameter of each circular recess, whereby the glass can be placed in any recess and moved from one recess to another during the playing of the checkers game;

each circular recess having a flat bottom surface and an annular frusto-conical side surface that angles upwardly and outwardly from said bottom surface;

each drinking glass comprising an upstanding circular annular transparent side wall extending upwardly from the aforementioned bottom wall to form a circular upper edge for the respective drinking glass; each transparent side wall having a height at least as great as the diameter of the associated circular bottom wall, whereby each drinking glass has a significant liquid capacity; each drinking glass having a colored band extending circumferentially around the surface of the annular transparent side wall a slight distance below the drinking glass upper edge; the upper edge of each colored band forming a liquid measuring line, whereby each glass can have the same quantity of liquid therein;

the annular bands on twelve of the glasses having one coloration, and the annular bands on the other twelve glasses having a different coloration, whereby the colored bands distinguish one player's checkers from the other player's checkers.

* * * * *